US006210023B1

(12) United States Patent
Evans

(10) Patent No.: US 6,210,023 B1
(45) Date of Patent: Apr. 3, 2001

(54) ANTI-NOISE SYSTEM FOR A MOVING OBJECT

(75) Inventor: Nigel Evans, West Midlands (GB)

(73) Assignee: Light & Sound Design, Ltd., Birmingham (GB)

( * ) Notice: Subject to any disclaimer, the term of this patent is extended or adjusted under 35 U.S.C. 154(b) by 0 days.

(21) Appl. No.: 09/153,729

(22) Filed: Sep. 15, 1998

(51) Int. Cl.[7] ..... F21V 14/08
(52) U.S. Cl. ..... 362/284; 362/322; 362/324
(58) Field of Search ..... 362/277, 280, 362/282, 284, 319, 323, 324, 391, 322, 390

(56) References Cited

U.S. PATENT DOCUMENTS 4,827,387 * 5/1989 Ferren et al. ..... 362/284
4,914,556 * 4/1990 Richardson ..... 362/277
5,857,759 * 1/1999 Latta et al. ..... 362/282

* cited by examiner

*Primary Examiner*—Y. Quach
(74) *Attorney, Agent, or Firm*—Fish & Richardson PC

(57) ABSTRACT

A stage lighting device has a light source for emitting light and a light modifying element for modifying such light. The light modifying element is coupled to a driven element which is rotationally coupled to a structural member so as to be rotatable about a first axis. The device has a noise-producing motor assembly with an output shaft. A driving element is coupled to the output shaft to be rotationally driven by the output shaft about a second axis. The driving element is coupled to the driven element by an endless loop element so as to rotationally drive the driven element about the first axis. A vibration-isolating mounting structure couples a motor assembly to the structural member and includes surfaces which vibrationally isolate the motor assembly from the structural member to attenuate vibration transferred from the motor assembly to the structural member. The mounting structure is pivotally coupled to the structural member with a pivotal range of motion about a pivot axis which is substantially parallel to the first axis. A tensioner couples the structural member to the mounting structure to bias the mounting structure in a first direction about the pivot axis so as to maintain a tension in the endless loop element.

16 Claims, 5 Drawing Sheets

ANTI-NOISE SYSTEM FOR A MOVING OBJECT

This invention relates to anti-noise connections in a motor-driven assembly, and more particularly to a combination of anti-noise elements which quiet the operation of such an assembly.

BACKGROUND AND SUMMARY OF THE INVENTION

The entertainment industry requires that lights and light modifying elements such as color changers be moved. Motors and other moving elements, however, are inherent sources of noise. The inventors of the present invention realized that silent operation is highly desirable so that an audience watching a theater production will not be disturbed.

However, there is a trade-off between the speed of movement of various elements and the amount of noise that they produce. Belts and pulleys can be just as noisy as gears, depending on the speed and quality. Belts and pulleys are very noisy when running fast. The first stage of a reduction train runs at speeds which are typically above 1500 rpm. This high speed operation invariably produces noise. At speeds below 1500 rpm, belt and pulley systems become much quieter. This is especially true when noise-reducing mechanisms, such as special tooth-cutting methods, are used. The belt and pulley uses a rubber belt to transmit the force from the driving pulley to the driven pulley. The belt and pulley inherently has low noise transmission and noise vibration. The damping effect of the belt in essence minimizes the transmission of noise and vibration.

Gears, on the other hand, transmit noise directly from the driving gear to the driven gear due to direct contact between the teeth.

The inventors recognized that belts do a very good job of preventing noise transmission so long as they are going slow. The inventors realized, therefore, that a belt in the final stage of the reduction train would help quiet the system. The high speed portion will inherently have noise therein. Since both gears and pulleys will cause noise, the inventors recognized that the quietest solution for the high speed portion is to use small plastic gears with small teeth. This portion will inherently have noise therein.

It is an object of the present invention to isolate this noise and prevent it from traveling through the rest of the system.

The inventors of the present invention noticed that such noise, although often masked by the sounds of the theater production, can prove very bothersome to the user. In order to obviate this problem, the inventors determined that a certain combination of elements minimizes the noise from such systems.

A preferred embodiment uses a connection between an output shaft of a motor and a pulley which is formed using an anti-noise element combination. The pulley is then connected via a belt to a driven shaft. One element of the anti-noise element combination includes a flexible coupling system which has inner surfaces which are substantially the same shape as the outer surface of the driving shafts. Typically these driving shafts are cylindrical. The flexible coupling has elements allowing tightening of these surfaces around the driving shaft. When a specific end of the coupling is tightened, it contracts in size around the shaft, thus tightly gripping the shaft.

Many different kinds of couplings are used. The most preferably used one includes a plurality of circumferential cuts through the middle portion. These cuts, and the material of the coupling, contribute to the ability of the flex coupling to flex in directions which are perpendicular to the axial direction. This has the advantage of minimizing the amount of direct physical noise across the coupling. Rubber grommets are preferably used to minimize driving motor and the plates supporting the pulley system.

The inventors also recognized that misalignment of shafts tends to cause even more noise, e.g. "creaks" and "groans". Another aspect addresses these problems adaptively adjusting a position of the output axis in a way that minimizes these problems.

Another aspect of the invention relates to tensioning an endless loop element which drives a light modifying element of a stage lighting device. The device has a light source for emitting light and a light modifying element for modifying such light. The light modifying element is coupled to a driven element which is rotationally coupled to a structural member so as to be rotatable about a first axis. The device has a noise-producing motor assembly with an output shaft. A driving element is coupled to the output shaft to be rotationally driven by the output shaft about a second axis. The driving element is coupled to the driven element by an endless loop element so as to rotationally drive the driven element about the first axis.

A vibration-isolating mounting structure couples a motor assembly to the structural member and includes surfaces which vibrationally isolate the motor assembly from the structural member to attenuate vibration transferred from the motor assembly to the structural member. The mounting structure is pivotally coupled to the structural member with a pivotal range of motion about a pivot axis which is substantially parallel to the first axis. A tensioner couples the structural member to the mounting structure to bias the mounting structure in a first direction about the pivot axis so as to maintain a tension in the endless loop element.

BRIEF DESCRIPTION OF THE DRAWINGS

These and other aspects of the invention will now be described in detail with reference to the accompanying drawings, wherein.

DESCRIPTION OF THE PREFERRED EMBODIMENT

Figure 1:
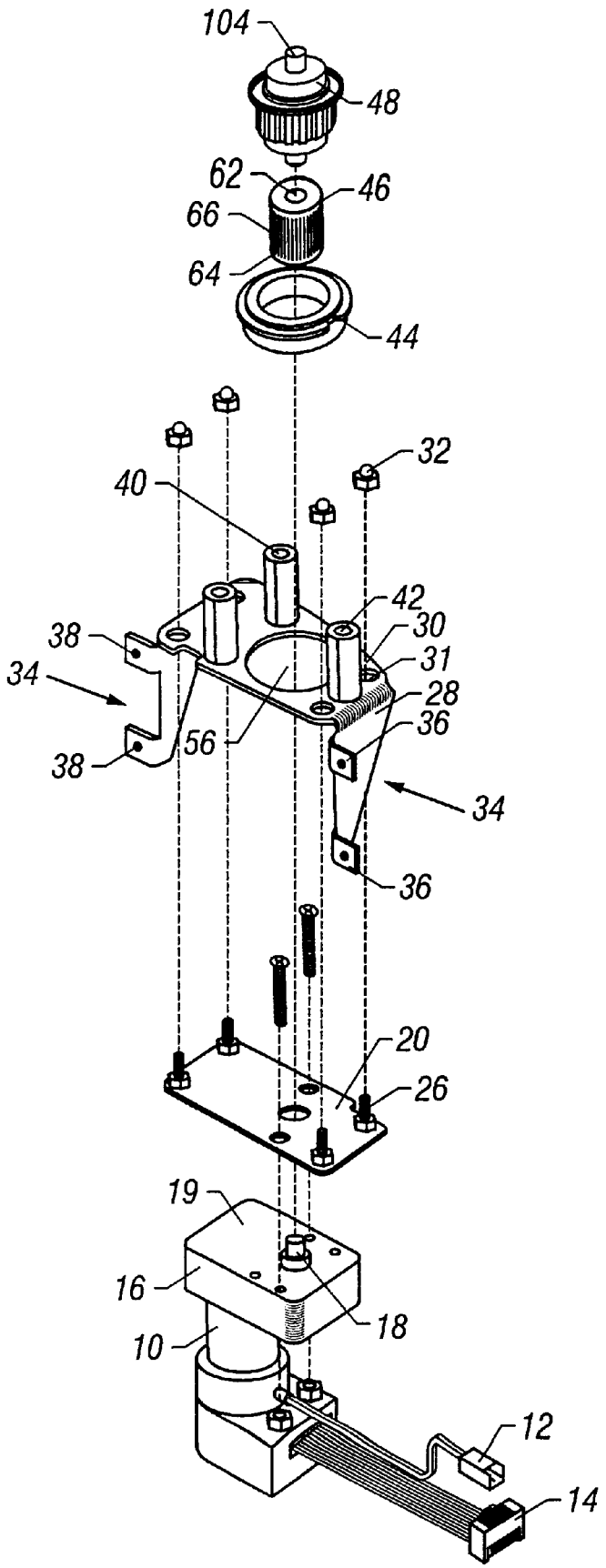
FIG. 1 is an exploded perspective view of a motor using the anti-noise elements of the present invention.

FIG. 1 illustrates a preferred embodiment of a motor assembly for use with the anti-noise elements of this invention.

FIG. 1 shows DC motor 10 having a power input 12 and a serial control input 14. Control input 14 is designed to attach to a mating plug from a control panel, computer, or similar controlling unit. The motor is controlled by applying power through line 12, and the resulting motion is monitored via encoder output 14.

The rotational output of motor 10 has a high speed, since this is the initial stage of the motor. As described above, the gears are preferably high quality plastic small gears which use well-known techniques to minimize the amount of noise they produce. Since, however, these gears run at high speed, they inherently produce noise.

Gearbox 16 reduces the speed of rotation as desired so that output shaft 18 produces the speed-reduced rotation.

Mounting plate 20 is attached directly to a surface 19 of the Gearbox 16.

The motor assembly is to be attached to another object, here bracket 28. The motor assembly, however, is noisy, and the pulley in the bracket 28 is not noisy.

Figure 2:
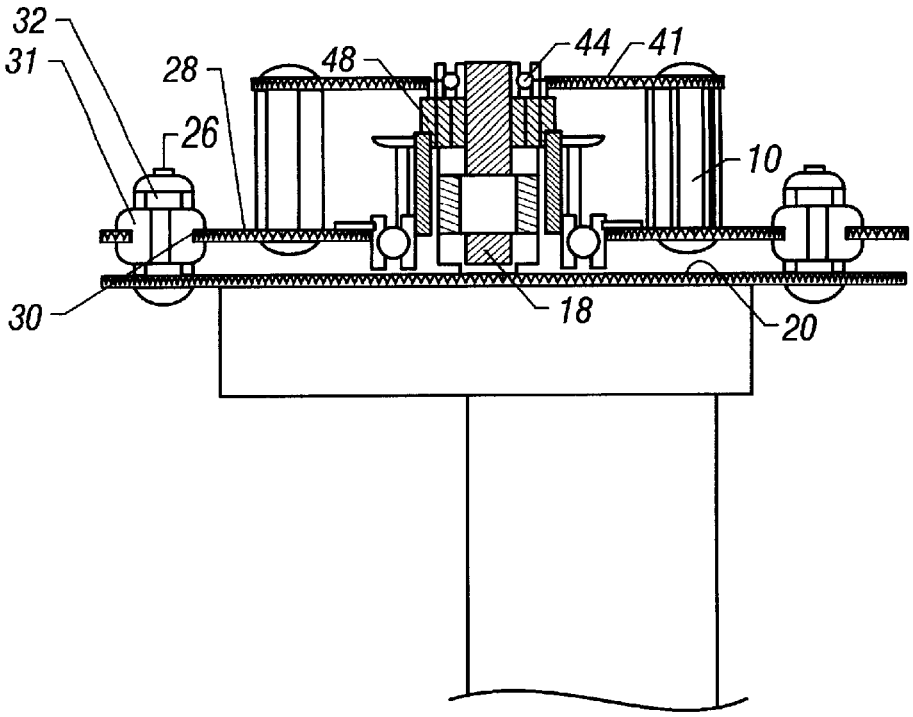
FIG. 2 is a cross-sectional view of an assembled anti-noise assembly according to a first embodiment of this invention.

Rubber grommets 31 are provided in holes 30 in attachment bracket 28 to prevent any metal to metal transmission between the attachment plate 20 and the bracket 28. FIG. 2 shows the arrangement of these grommets in detail. The grommet 31 fills a hole 30. A screw 26 goes through the hole within the grommet 31. The screw 26 is held in place by nut 32. This hence holds the motor assembly to the bracket 28, and effectively prevents metal-to-metal contact between the plate 20 and bracket 28.

Bracket 28 preferably includes extending legs 34 including holes allowing attachment to another object tabs 36. Each tab 36 includes a mounting aperture 38 formed therein. Only the low noise side of the motor assembly is connected to the bracket 28. The high speed motor is left "hanging"; held by the screws and grommets. The high speed motor can hence be wiggled and moved relative to the frame on which it is mounted. This further facilitates isolating the noise produced by this high speed motor.

Stand-offs 40 are attached to a top surface of attachment bracket 28. Each stand-off top surface includes threaded aperture 42 to receive a bolt which holds the pulley 48 in place.

Lower bearing 44, flexible coupling 46 and pulley 48 all cooperate to transmit power from output shaft 18 to a belt and thereby to a shaft to be driven by the assembly. This shaft can be used to drive a color changer, pan and/or tilt functions in a moving light, or any in other device where minimization of noise is important.

Lower bearing 44 is held within a receiving opening 56 in attachment bracket 28. Lower bearing 44 includes inner surfaces defining an area within which pulley 48 is rotated. These inner surfaces are appropriately shaped to facilitate rotational movement of the pulley 48.

Pulley 48 typically includes a belt wound therearound to provide power to a driven element. Since this pulley is downstream of the speed reduction carried out by the gear mechanism in Gearbox 16, however, the pulley operation can be relatively quiet.

According to the present embodiment, a noise-isolating element 46 couples between the shaft 18 from the Gearbox and the shaft 104 from the pulley. This noise-isolating element, according to this embodiment, needs to be an element which provides some measure of sound isolation between the two elements. The preferred mode uses the flexible coupling described above. This is an element often used for coupling mis-matched shafts. Other similar elements, however, can alternately be used. These include other kinds of flexible coupling elements, or any means which connects rotating elements while attenuating the sound therefrom. For example, the noise-isolating element could be embodied by a bellows, a coiled spring or other elements. The flexible coupling elements described herein are advantageous in their constant velocity and high strength.

One example of a suitable flexible coupling is described in U.S. Pat. No. 3,068,668, the contents of which are hereby incorporated by reference.

The flexible coupling includes a plurality of circumferential cuts which allow the flexing of the coupling. These circumferential cuts 66 allow the top portion of flexible coupling 46 to flex relative to bottom portion so that the solid top portion and the solid bottom portion need not be parallel to each other. Flexing of the coupling 46 also permits the bottom and top portions to become slightly relatively displaced laterally from each other and longitudinally toward and away from each other. This operation compensates any mismatches due to irregularities or eccentricities of output shaft 18 and drive shaft 104. In addition to attenuating lateral, longitudinal and angular vibration, the flexible coupling may attenuate slight rotational vibration associated with fluctuations in the speed of the motor, lash in the gearbox, and the like.

Circumferential cuts 66 may be either helically formed in the flexible coupling 46 or may be individual circumferential rings. There must be some locations where the cuts do not extend through the entire diameter, to prevent one portion of the coupling from separating from the other. In either case, circumferential cuts 66 may be formed when the flexible coupling 46 is initially injection molded, or may be formed afterwards by appropriate and well-known machining methods.

Flexible coupling 46 may be formed of metal, or of a flexible material such as rubber or other appropriate resilient, bendable material. Alternatively, flexible coupling 46 may be formed of spring steel or other metal molded within rubber. Flexible coupling 46 is preferably integrally molded with top and bottom solid portions 62 and 64, but these solid portions may be individually manufactured and later attached to the intermediate flexible portion containing the circumferential cuts 66. Flexible coupling 46 is preferably pressure molded, but may be formed according to other appropriate manufacturing techniques, well known in the art.

Figure 3:
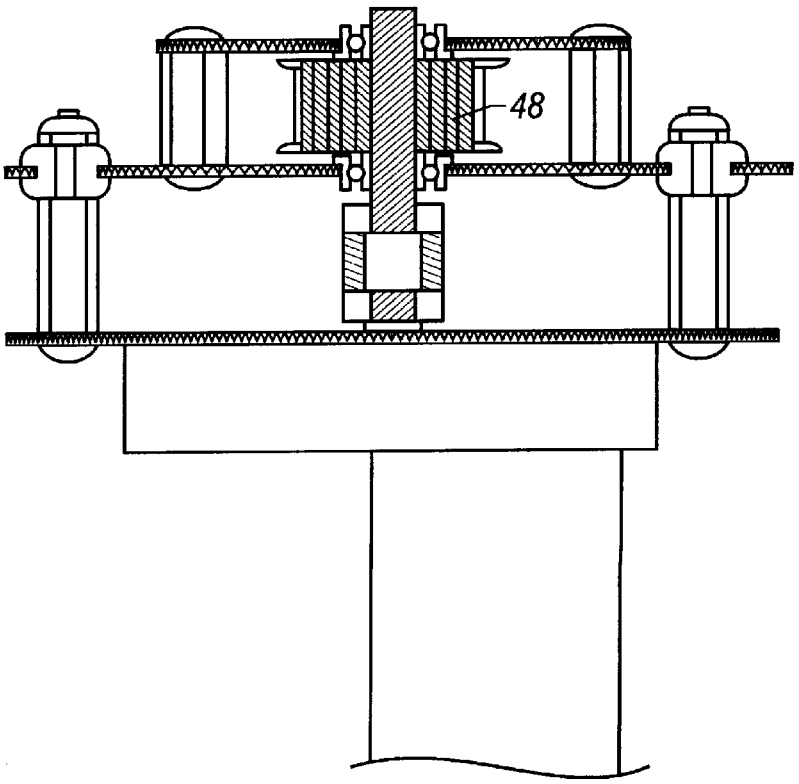
FIG. 3 is a cross-sectional view of an assembled anti-noise assembly according to a second embodiment of this invention.

FIGS. 2 and 3 show more clearly the construction of this invention when assembled. FIG. 2 shows a first embodiment in which the shaft and flexible coupling are held within the hollow pulley 48. The second embodiment of FIG. 3 has a solid pulley 48, and the coupling is hence outside the boundaries of the shaft.

Output shaft 18 is connected to the bottom surface of flexible coupling 46 which also holds output shaft 104. Output shaft 104 holds pulley 48 which is supported in bearing 44. In this manner, rotation of the output shaft of the high speed motor 10 is transmitted via flexible coupling to shaft 104 and thus to pulley 48. A belt disposed around pulley 48 thereby transmits power from the motor to a shaft to be driven.

Pulley 48 is held in place by a retaining assembly comprising standoffs 40 and top plate 41.

In operation, the motor 10 is powered by power source through input 12 and monitored via encoder output 14. Upon input of power through input 12, the motor rotates, thereby rotating the output shaft 18 according to the appropriate ratio of Gearbox 16.

Rotational motion of the output shaft 18 causes rotation of the flexible coupling 46 which transfers the rotational motion to the shaft 104 and thereby to pulley 48.

While this flexible coupling 46 has been described as joining a motor shaft with a pulley shaft, it should be clear that this flexible coupling system may also be used to couple a shaft and a pulley shaft at a distance remote from a motor.

Figure 4:
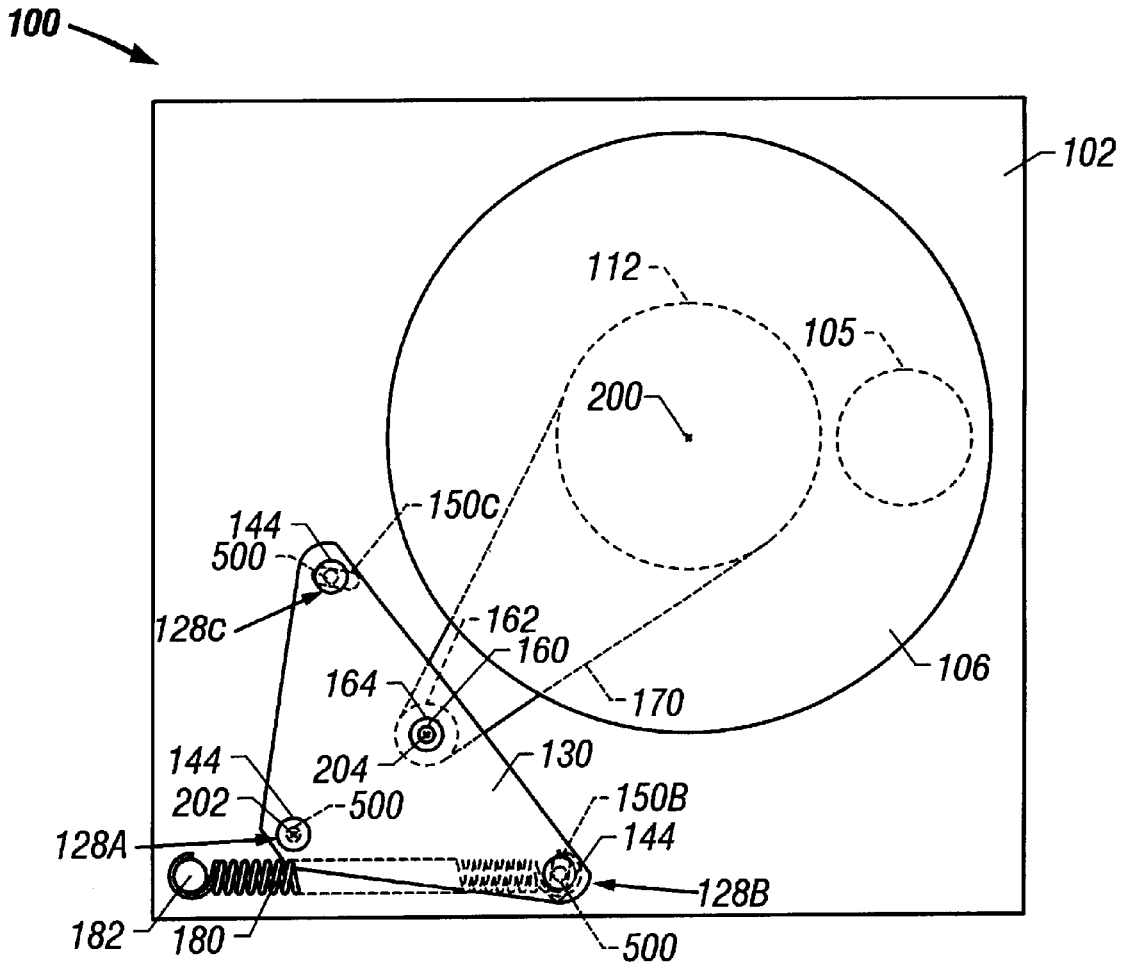
FIG. 4 is a partial front view of a lighting system having an anti-noise assembly according to a third embodiment of this invention.
Figure 5:
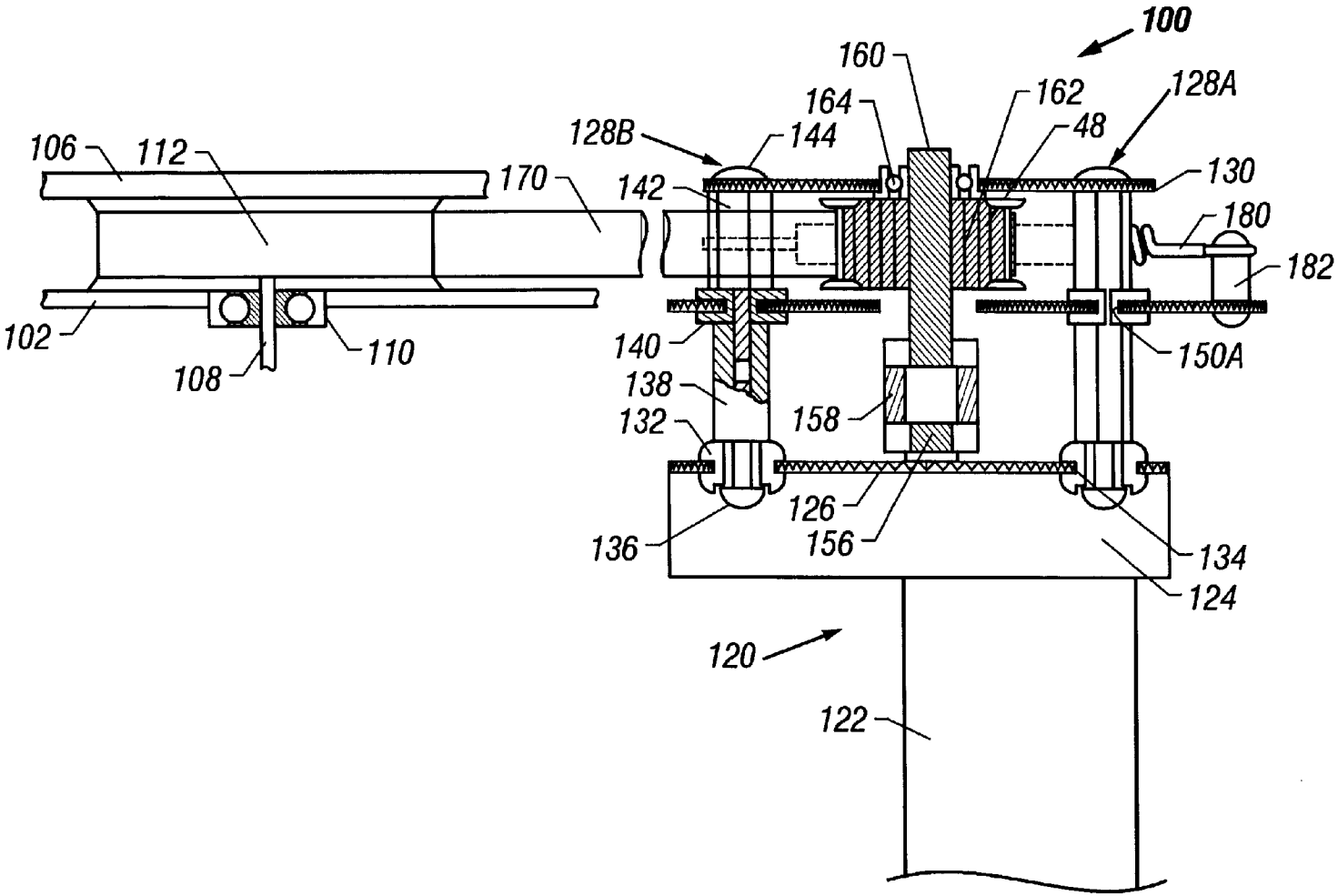
FIG. 5 is a partial cross-sectional view of the system of FIG. 4.

FIGS. 4 and 5 illustrate a lighting system 100 incorporating another embodiment. The system 100 includes a structural member such as an equipment chassis 102. A light source 105 which may comprise one or more bulbs of one or more types is carried by the chassis. A light modifying element such as a movable color filtering element 106 is placed in front of the source to alter a beam of light emitted by the source. The element 106 is carried by the chassis 102 for rotation about the central axis 200 of the element 106. In the illustrated embodiment, the element 106 is carried by a central shaft 108 which is held by a bearing 110 secured in an aperture in the chassis 102. A pulley 112 is secured concentrically to the shaft 108 and thus to the element 106.

A drive system 120 is also carried by the chassis 102. The drive system 120 includes a motor 122 and a gearbox 124 which may be similar to the motor 10 and gearbox 16 of the embodiment of FIG. 1. A mounting plate 126 may be secured to the gearbox and motor in similar fashion as mounting plate 20 is to gearbox 16 and motor 10. As shown in FIG. 4, and in further detail in FIG. 5, the motor and gearbox are mounted on the chassis 102 by a mounting structure including three stand-off assemblies 128A–128C which extend from the mounting plate 126, through the chassis 102 and to a top plate 130. At its end proximate the motor and gearbox (hereinafter the "proximal end") each stand-off assembly 128A–128C includes a rubber grommet 132 provided in a hole 134 in the mounting plate 126. A screw 136 extends through a central hole or channel in the grommet and is threaded into a proximal end of a first stand-off 138 having a threaded longitudinal aperture to accommodate and engage the screw. A spool 140 is sandwiched between a distal end of stand-off 138 and a proximal end of a second stand-off 142. The distal end of the second stand-off 142 contacts the top plate 130. A second screw 144 extends proximally through a hole in the top plate, through the second stand-off 142, through the spool 140 and into the first stand-off 138. Engagement of the slot attachment 144 of each stand-off assembly 128A–128C establish the top plate, first and second stand-offs 138 and 142 and spools 140 as a rigid unit. The spools 140 of the respective stand-off assemblies 128A–128B are accommodated by respective apertures 150A–150C in the chassis 102. The aperture 150A (FIG. 5) is a circular hole, closely accommodating the spool and substantially allowing only rotation of the spool and stand-off assembly 128A about a pivot axis 202. As shown in FIG. 4, the apertures 150B and 150C are formed as slots centered about the axis 202. The spools 140 of stand-off assemblies 128B and 128C slide within the associated slots 150B and 150C so that the drive system may pivot about the axis 202 in pivotal motion constrained by engagement of the spools with the ends of the associated slots.

As shown in FIG. 5, an output drive shaft 156 extends distally from the gearbox 124. A flexible coupling 158 which may be similar to flexible coupling 46 of FIG. 1 is connected at its proximal end to the distal end of the shaft 156 and at its distal end to the proximal end of a pulley shaft 160. The shaft 160 extends through an aperture in the chassis and securely carries a drive pulley 162. The shaft 160 extends through the top plate 130 and is rotatably coupled to the top plate 130 by a bearing 164. Optionally, an intermediate reinforcing plate may connect the stand-off assemblies. Such intermediate reinforcing plate may be positioned on either side of the chassis 102. For example, it may be positioned between the chassis 102 and the pulley 162. Such a plate may carry a bearing engaging the shaft 160 to provide complimentary support to that provided by the bearing 164. A belt 170 forms an endless loop encircling the pulleys 162 and 112 to transmit torque and rotation therebetween so as to allow the pulley 162 to drive the pulley 112 and thus drive the element 106.

A tensioning mechanism maintains tension in the belt 170. The tensioning mechanism includes a bias producing device in the form of a coil spring 180 which biases the drive system 120 in a first direction, here clockwise as shown in FIG. 4, about the axis 202. The spring 180 is secured to a post 182 extending from the chassis 102 at one end. At its other end, the spring is secured to the second stand-off 142 of the stand-off assembly 128B. The spring 180 is under tension to draw the stand-off assembly 128B toward the post 182.

It can thus be seen the combination of the grommets 132 and the flexible coupling 158 effectively isolate the chassis 102 and pulley 162 from noise-producing vibration of the motor 122 and gearbox 124.

To describe this in further detail, an important advantage of the present system is the way in which the belt is automatically tightened. Previous self belt tightening systems have this type have been known. However, those previous systems often actually tilted the axis of one pulley relative to another. The inventors found that this tilting tends to cause creaks and groans, thereby adding to an amount of noise which is produced by the resultant system. The system of the present invention, in contrast, automatically tightens the belt in a way that forces that the axis of the adjusted pulley to remain in the same axis at all times.

Returning to FIG. 4, a spring element 180 tensions the device so that a predetermined amount of tension is also placed on the belt 170. The device is attached at stand-off assemblies 128A–C. Stand-off assemblies 128A and 128B each include a connecting element 500 within oversized slots 150B and 150C. The connecting elements 500 can slide within the slots 150B, 150C, allowing the overall device to pivot on the connector 202.

This has the effect of tightening the belt while maintaining the axis of the driving output 204 substantially parallel to the axis of pulley 200.

As explained above, this preferably done by using grommets 132 which have some extra space allowing the grommet 132 to slide within its connection point.

Figure 6:
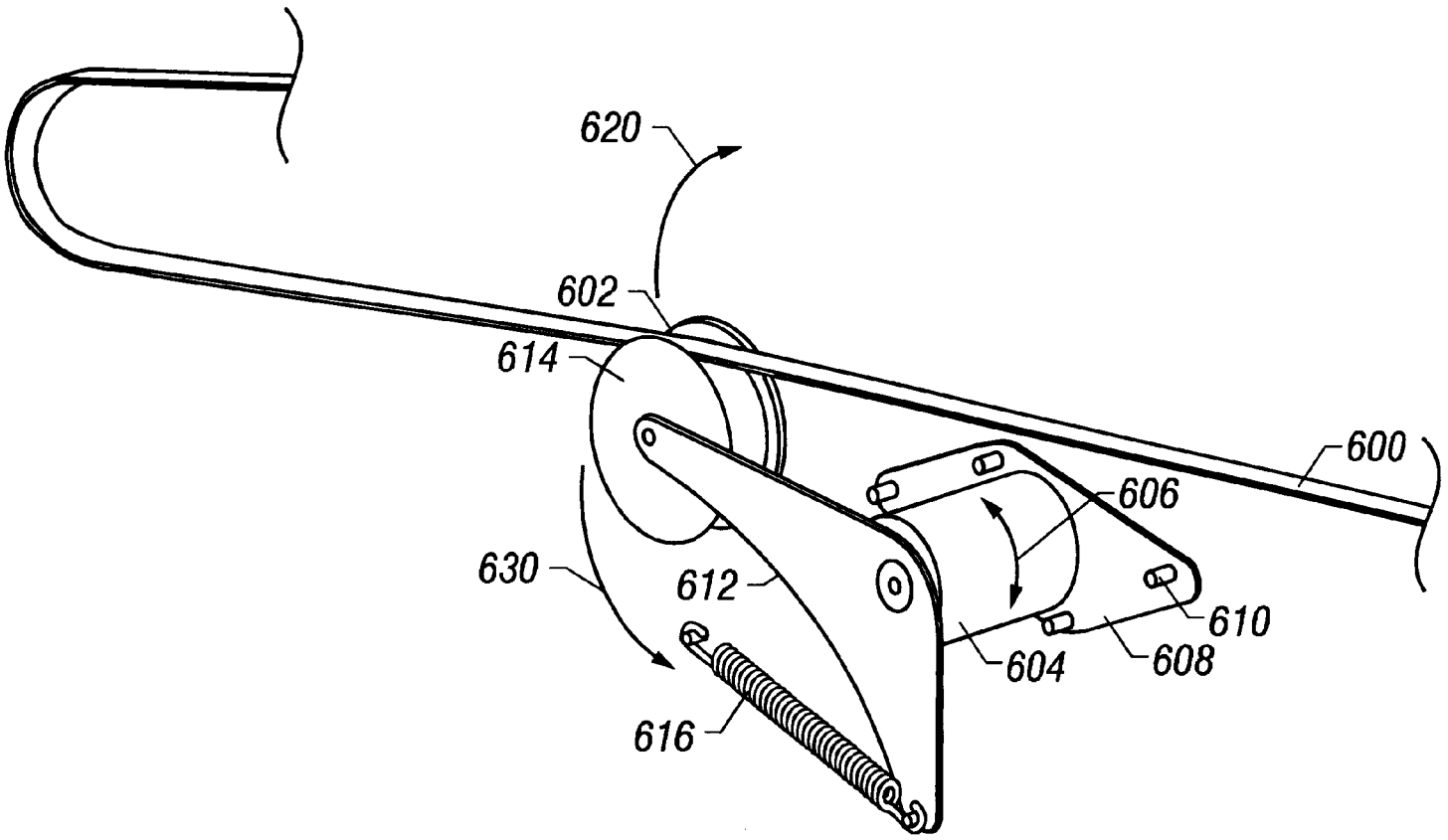
FIG. 6 is a perspective view of a damper assembly according to another embodiment.

An alternative embodiment carries out automatic belt tensioning using a damper assembly with a tensioner spring. The embodiment is shown in FIG. 6. The belt 600 is contacted by a tensioning assembly 602. The tensioning assembly includes a one-way rotary damper 604 which can rotate in the direction shown by arrow 606. One-way rotary damper 604 is damped in one direction but is free in the other direction. One-way rotary damper 604 is also fixed to the chassis 608 via attachment mechanism 610.

Attached to the end of the one-way rotary damper 604 is an idler arm 612 which holds an idler 614 at one end thereof. The idler spins freely, to allow the belt to move across it. The other end of idler arm 612 includes a spring hole 614 with an attached spring 616. The other end of spring 616 is also anchored to the chassis 608. The strength of the tensioner spring 616 controls the amount of tension which is placed on the belt 600. Tensioner spring 616 biases more tension into the belt 600, in the direction 620, representing the free rotation direction of the damper. In the opposite direction, the movement is damped, and hence oscillations on the belt will not cause substantial movement in the direction 630.

The result is that the belt is tensioned constantly by an amount set by the spring 616. Different strengths of springs can be used for different amounts of tensioning. Alternately, some type of variable spring, such as a spring with a turn buckle could be used.

Although this invention has been fully described by way of example with reference to the accompanying drawings, it is to be understood that various changes and modifications will be apparent to those skilled in the art.

For example, the flexible coupling could be replaced as described above. The invention is not limited to the gears and belt drives that are mentioned herein; instead any kind of drive system could be used. The actual mounting techniques could also be replaced by any other standard technique. Additional levels of isolation may be provided such as by resiliently mounting the light modifying element to the chassis. Other modifications are contemplated.

What is claimed is:

1. A drive system which drives a light modifying element of a stage lighting assembly, comprising:

a structural member;

a light modifying element;

a driven element rotationally coupled to the structural member so as to be rotatable about a first axis and coupled to the light modifying element so as to drive the light modifying element;

a motor assembly having an output shaft, said motor assembly producing vibration;

an endless loop element;

a driving element coupled to the output shaft so as to be rotationally driven by the output shaft about a second axis and coupled to the driven element by the endless loop element so as to rotationally drive the driven element about the first axis;

a mounting structure holding said driving element, said mounting structure pivotally coupled to the structural member with a pivotal range of motion about a pivot axis substantially parallel to the first axis; and a tensioner having a first portion connected to the structural member through a connecting element and a second portion connected to the mounting structure, said tensioner operating to bias the mounting structure in a first direction, said bias causing movement about the pivot axis so as to maintain a tension in the endless loop element while maintaining said first axis parallel to said second axis.

2. The system of claim 1, wherein the tensioner comprises a coil spring, held under tension between the structural member and the mounting structure.

3. The system of claim 1, comprising a first vibration attenuating element coupling the output shaft to the drive element and rotating with the output shaft and the drive element as a unit, and wherein the mounting structure comprises a second vibration attenuating element coupling the motor assembly to the structural member.

4. The system of claim 3, wherein the second vibration attenuating element comprises an elastomeric grommet.

5. The system of claim 1, wherein the mounting structure comprises:

a first element extending through a first aperture in the structural member along the pivot axis; and second and third elements extending through respective second and third apertures in the structural member and respectively moveable within such second and third apertures upon rotation of the mounting structure about the pivot axis.

6. The system of claim 1, wherein the driving element comprises a first pulley, wherein the driven element comprises a second pulley, and wherein the endless loop element comprises a belt, encircling and engaged to the first and second pulleys.

7. The system of claim 6, further comprising a pulley shaft secured to the first pulley and wherein the mounting structure comprises a plate and a bearing coupling the plate to the pulley shaft.

8. The system of claim 1, wherein said motor assembly includes a high speed motor and a reducing gearbox assembly.

9. The system of claim 1, wherein the driving element is coupled to the output shaft by an anti-noise coupling element comprising a cylindrical device with an isolation cut disposed about a middle portion and first annular recess and second annular recess formed in respective first and second ends, said output shaft of said motor assembly being disposed in the first annular recess, the second annular recess formed to receive a driven shaft.

10. The system of claim 1, wherein the driving element is coupled to the output shaft by an anti-noise coupling element configured to attenuate vibration of the driving element and output shaft toward and away from each other, laterally relative to each other, and angularly relative to each other.

11. The system of claim 1, wherein the connecting element comprises a post.

12. A method of biasing a belt comprising:

providing a light modifying element connected to a first shaft having a first axis, said element being rotatable about the first axis;

providing a motor assembly having an output shaft along a second axis parallel to said first axis;

using said motor assembly to rotate said light modifying element via a belt; and tensioning said belt by moving one of said output shaft and said first shaft relative to the other one of said output shaft and said first shaft while maintaining said first axis parallel to said second axis.

13. A method of reducing vibration in a light system having a rotatable light modifying element for modifying light emitted by a light source, comprising:

providing a light system having a light modifying element carried for rotation about a first axis;

providing a structural member;

providing a motor assembly having a shaft;

attaching a frame to said motor assembly;

pivotally mounting the frame to the structural member with a pivotal range of motion about a pivot axis substantially parallel to the first axis, the frame mounted to the motor assembly to inhibit transmission of vibration from the motor assembly to the light modifying element;

coupling the shaft of the motor assembly to the light modifying element for driving the light modifying element via an endless driving element; and biasing the frame in a first direction about the pivot axis so as to maintain a tension in the driving element.

14. A self tensioning bias system for a stage lighting operation, comprising:

a motor, having an output shaft which extends along a first axis;

a driven element, comprising a color changing portion of a stage lighting assembly, said driven element rotatable around a second axis which is substantially parallel to said first axis;

a belt connecting an output of said motor shaft to said driven element;

a housing connected to one of said output shaft of said motor and said driven element and adapted to provide relative connection of said output shaft to said driven element, said housing including a pivotal connection including at least three connection points, one of which is rotatable, and at least one of which includes an elongated slot portion allowing movement of said housing along a specified direction.

15. The system of claim 14 further comprising:

a mounting element comprising at least three holes corresponding to the at least three connection points of said housing;

a grommet, said grommet having one dimension smaller than one of said holes and which is placed into said hole; and at least one connecting element having a first end connected to one of said three connection points and a second end extending through said grommet.

16. The system of claim 15 wherein the connecting element is a screw.

* * * * *